US011242611B2

(12) United States Patent
Chou et al.

(10) Patent No.: US 11,242,611 B2
(45) Date of Patent: Feb. 8, 2022

(54) NOZZLE DEVICE

(71) Applicant: National Taiwan Ocean University, Keelung (TW)

(72) Inventors: Chau-Chang Chou, New Taipei (TW); Xiao-Li Wang, Lianyungang (CN)

(73) Assignee: NATIONAL TAIWAN OCEAN UNIVERSITY, Keelung (TW)

( * ) Notice: Subject to any disclaimer, the term of this patent is extended or adjusted under 35 U.S.C. 154(b) by 119 days.

(21) Appl. No.: 16/856,722

(22) Filed: Apr. 23, 2020

(65) Prior Publication Data

US 2021/0254234 A1 Aug. 19, 2021

(30) Foreign Application Priority Data

Feb. 18, 2020 (TW) ..... 109105159

(51) Int. Cl.
*C25D 5/08* (2006.01)
*C25D 17/00* (2006.01)
*C25F 3/02* (2006.01)

(52) U.S. Cl.
CPC ..... *C25D 5/08* (2013.01); *C25D 17/00* (2013.01); *C25F 3/02* (2013.01)

(58) Field of Classification Search
CPC .... C25D 5/08; C25F 3/02–14; B23H 3/00–10
See application file for complete search history.

(56) References Cited

FOREIGN PATENT DOCUMENTS

| | | |
|---|---|---|
| CN | 109794659 A | 5/2019 |
| JP | 9-27312 A | 1/1997 |

*Primary Examiner* — Ho-Sung Chung
(74) *Attorney, Agent, or Firm* — Birch, Stewart, Kolasch & Birch, LLP

(57) ABSTRACT

A nozzle device includes a nozzle body and at least one second electrode. The nozzle body extends along a longitudinal axis, and has a top surface, a bottom surface for confronting a first electrode of a workpiece, a recess provided in the bottom surface, and a longitudinal channel extending downwardly from the top surface along the longitudinal axis to be in fluid communication with the recess. The longitudinal channel has an upper section and a lower tapered section which is tapered downwardly to form a lower communication port. The least one second electrode is disposed in the recess for being spaced apart from the first electrode.

4 Claims, 19 Drawing Sheets

NOZZLE DEVICE

CROSS-REFERENCE TO RELATED APPLICATION

This application claims priority from Taiwanese invention patent application no. 109105159, filed on Feb. 18, 2020.

FIELD

The disclosure relates to a nozzle device, more particularly to a nozzle device for subjecting a workpiece to an electrochemical process.

BACKGROUND

A jet electroplating process has become widely used in recent years since such process may be rapidly implemented on a selected region (such as a worn or damaged region, a blind hole, a high aspect ratio hole) of a workpiece. As shown in FIGS. 1 and 2, a conventional nozzle 9 for implementing the jet electroplating process may have a supplying channel 90 for supplying an electrolytic solution (not shown) to a first electrode of a workpiece (not shown). The supplying channel 90 may include an upper section 91 and a lower tapered section 92 on which a second electrode (not shown) is mounted. Although the electrolytic solution may be converged by the nozzle 9 to a selected region of the workpiece, the selected region is subjected to a relatively high shear stress and the electrolytic solution may have an uneven electric field distribution between the first and second electrodes. This may adversely affect the plating efficiency and uniformity.

SUMMARY

Therefore, an object of the disclosure is to provide a nozzle device for subjecting a workpiece to an electrochemical process, which is useful in improving plating or etching efficiency and uniformity.

According to the disclosure, a nozzle device is provided for subjecting a workpiece to an electrochemical process. The workpiece has a first electrode. The nozzle device includes a nozzle body and at least one second electrode. The nozzle body extends along a longitudinal axis to terminate at a top surface and a bottom surface for confronting the first electrode of the workpiece. The nozzle body has a recess provided in the bottom surface, and a longitudinal channel extending downwardly from the top surface along the longitudinal axis to be in fluid communication with the recess. The longitudinal channel has an upper section and a lower tapered section which is tapered downwardly to form a lower communication port. The second electrode is disposed in the recess for being spaced apart from the first electrode.

Because the recess is provided in the bottom surface of the nozzle body and because the second electrode is provided in the recess, an electrolytic solution may have a more even electric field distribution between the first and second electrodes, and a selected region on the workpiece may be evenly plated or etched.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

Figure 1:
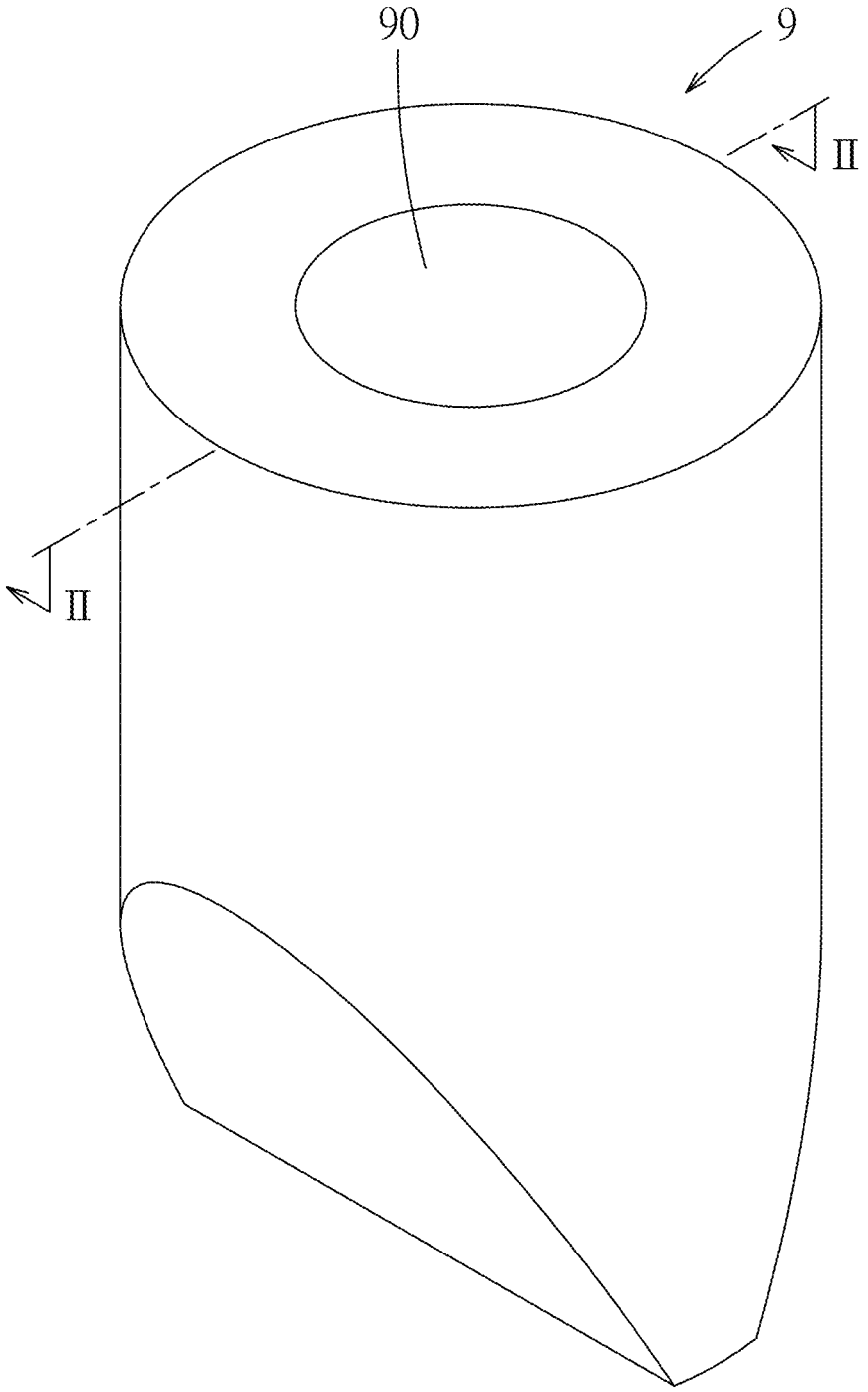
FIG. 1 PRIOR ART
FIG. 1 is a schematic perspective view of a conventional jet electroplating nozzle.
Figure 2:
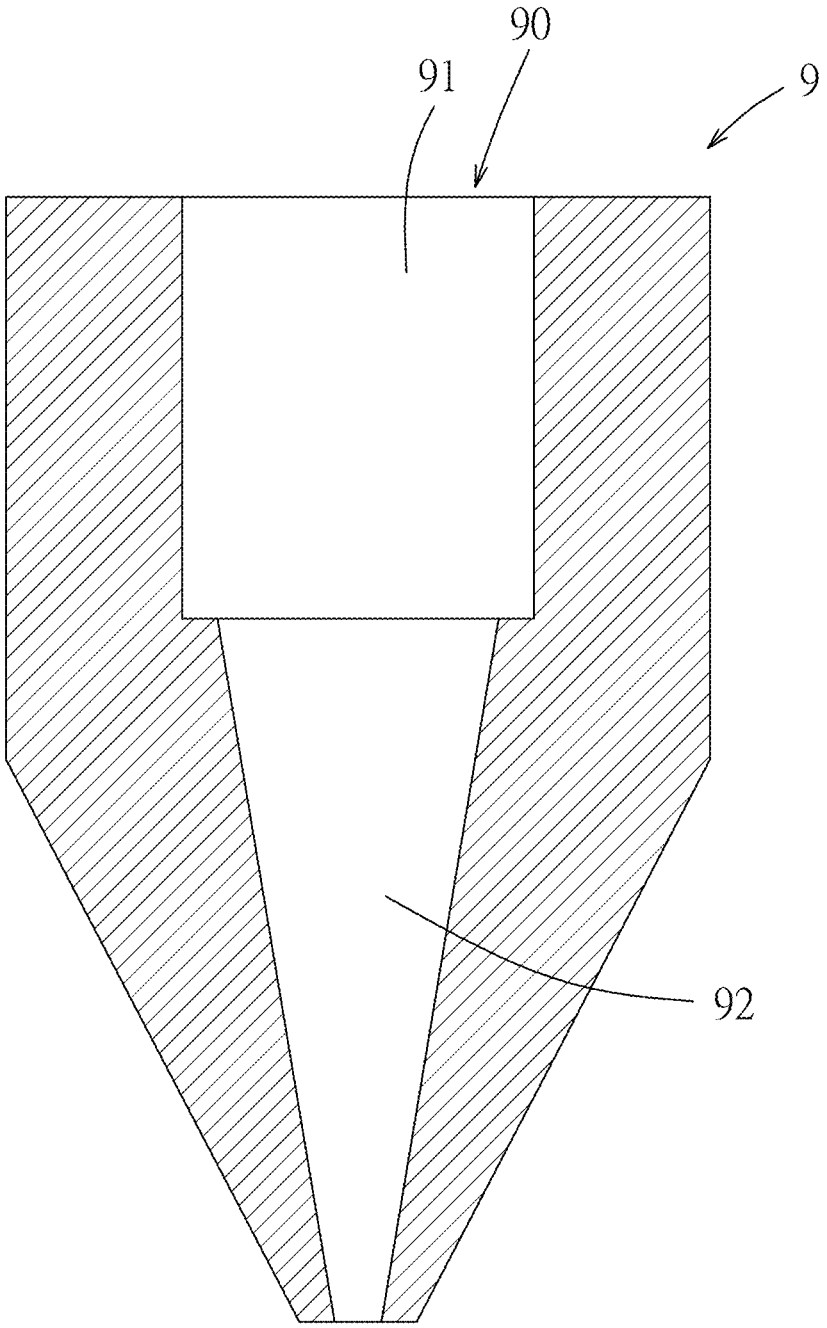
FIG. 2 PRIOR ART
FIG. 2 is a cross-sectional view taken along line II-II of FIG. 1.

Before the disclosure is described in greater detail, it should be noted that where considered appropriate, reference numerals have been repeated among the figures to indicate corresponding or analogous elements, which may optionally have similar characteristics.

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Figure 3:
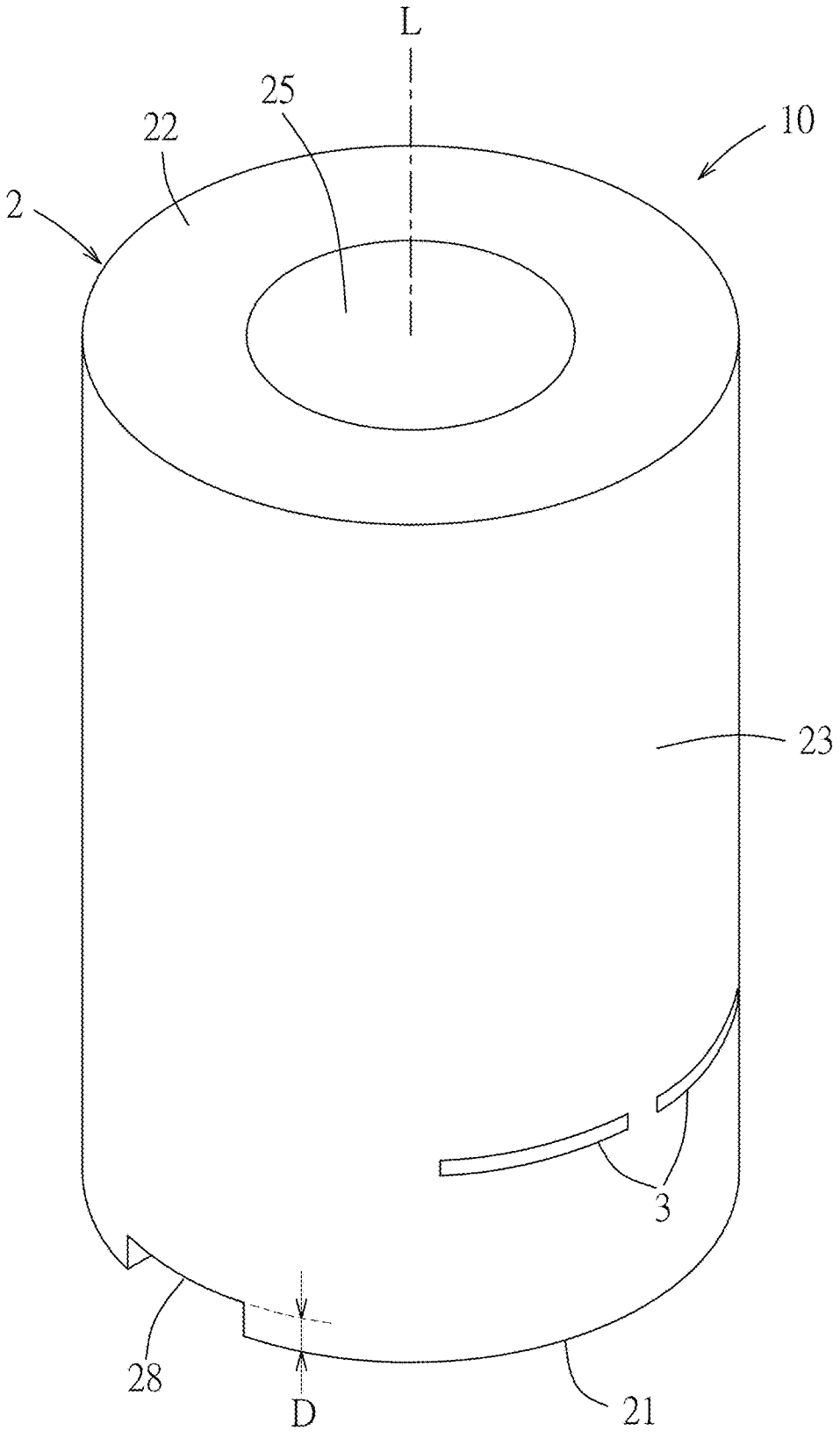
FIG. 3 is a schematic perspective view of a nozzle device according to a first embodiment of the disclosure.
Figure 4:
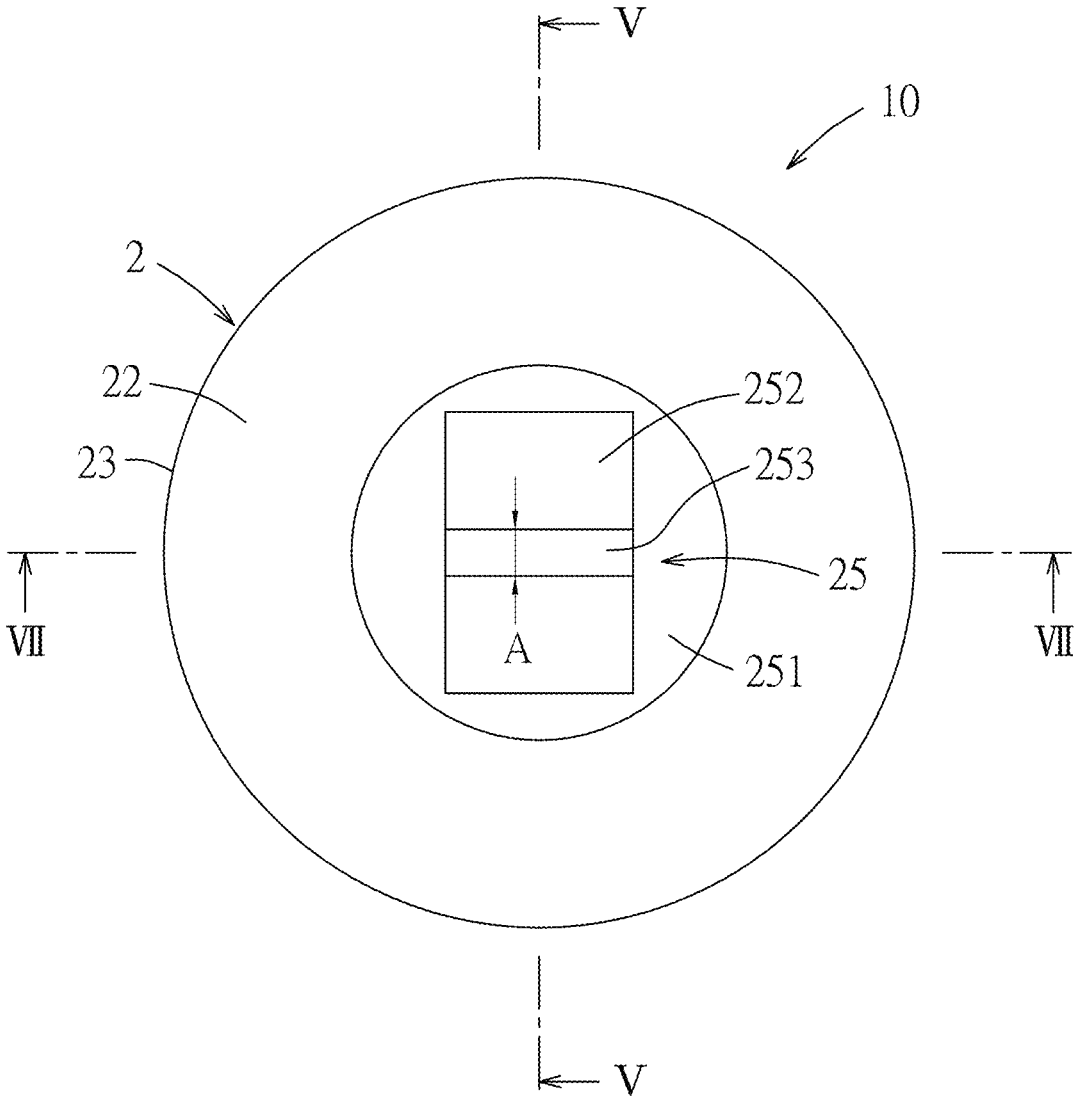
FIG. 4 is a top view of the first embodiment.
Figure 5:
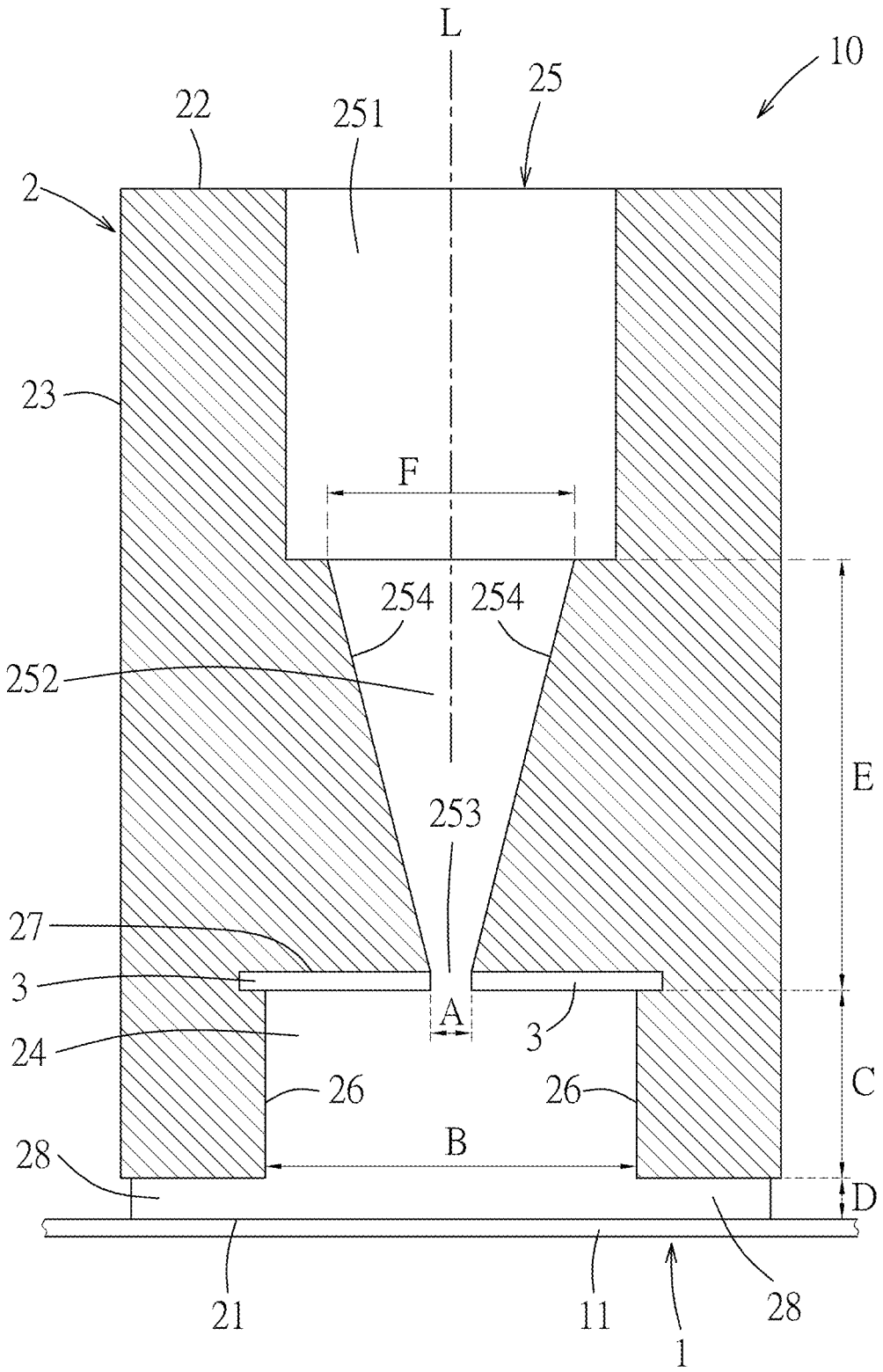
FIG. 5 is a cross-sectional view taken along line V-V of FIG. 4.

Referring to FIGS. 3 to 5, a nozzle device 10 according to a first embodiment of the disclosure is shown to include a nozzle body 2 and at least one second electrode 3. The nozzle device 10 is provided for subjecting a workpiece 1 to an electrochemical process which may be an electroplating process or an electroetching process. The workpiece 1 has a first electrode 11. The electroplating process is exemplified in this embodiment, and thus, the first electrode 11 is a cathode, and the second electrode 3 is an anode. For an electroetching process, the first electrode 11 is an anode, and the second electrode 3 is a cathode.

The nozzle body 2 extends along a longitudinal axis (L) to terminate at a top surface 22 and a bottom surface 21 for confronting the first electrode 11 of the workpiece 1. The nozzle body 2 has an outer peripheral surface 23 interconnecting the top and bottom surfaces 22, 21, a recess 24 provided in the bottom surface 21, and a longitudinal channel 25 extending downwardly from the top surface 22 along the longitudinal axis (L) to be in fluid communication with the recess 24. The longitudinal channel 25 has an upper section 251 and a lower tapered section 252 which is tapered downwardly to form a lower communication port 253. In an embodiment shown in FIG. 3, the nozzle body 2 is in a cylinder form.

Figure 6:
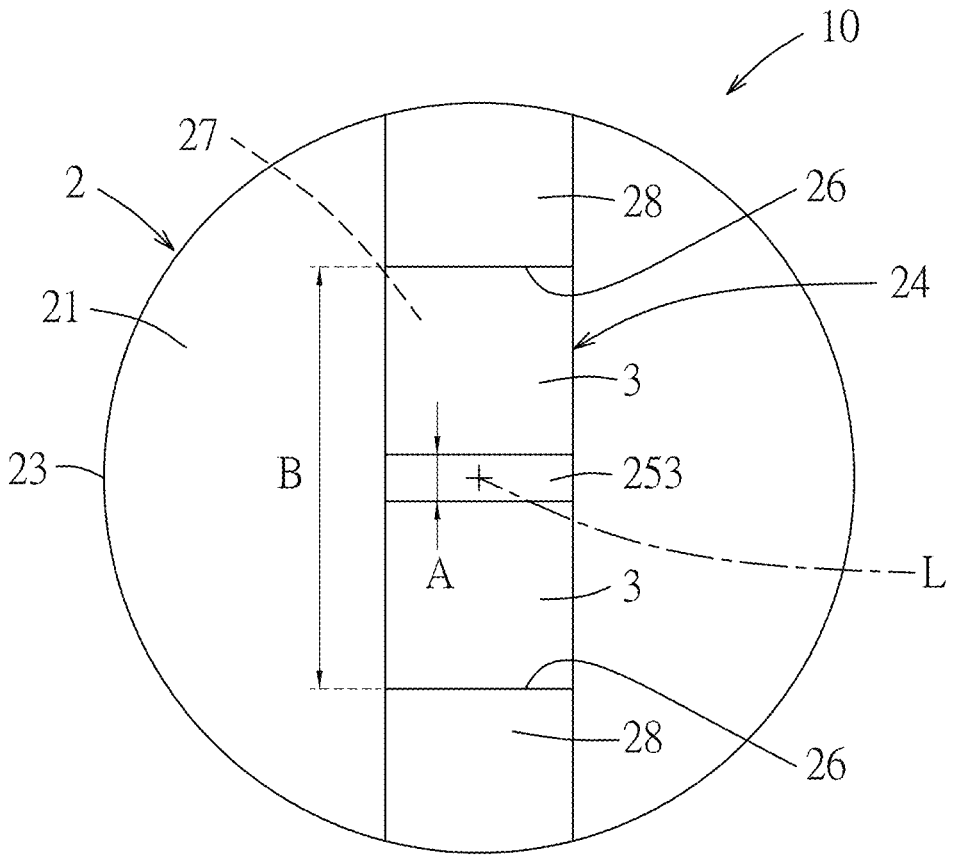
FIG. 6 is a bottom view of the first embodiment.
Figure 7:
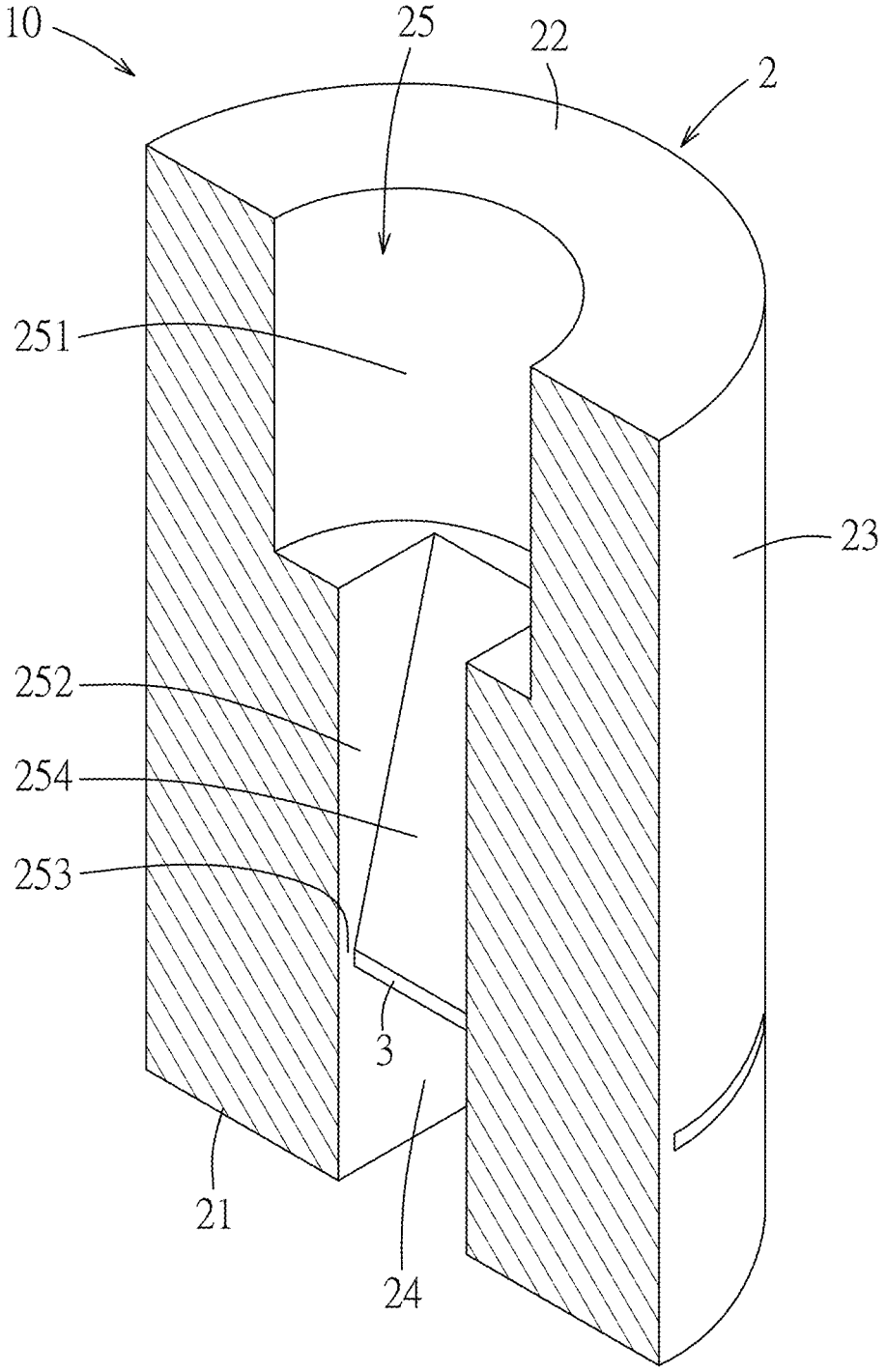
FIG. 7 is a cross-sectional view taken along line VII-VII of FIG. 4.

In an embodiment shown in FIGS. 5 and 7, the lower tapered section 252 may have two inclined planar regions 254 which are opposite to each other in a radial direction relative to the longitudinal axis (L), and which are disposed at two opposite sides of the lower communication port 253. The lower communication port 253 may be elongated in another radial direction orthogonal to the radial direction to have a rectangular shape (see also FIGS. 4 and 6).

In an embodiment shown in FIGS. 5 and 6, the recess has an upper end surface 27 in which the lower communication port 253 is formed, and is elongated in the radial direction to terminate at two lateral end surfaces 26 each extending in a direction of the longitudinal axis (L) to be disposed between the upper end surface 27 and the bottom surface 21.

The at least one second electrode 3 is disposed in the recess 24 for being spaced apart from the first electrode 11.

In an embodiment shown in FIGS. 3, 5, and 6, the nozzle device 10 may include two of the second electrodes 3 which are disposed in the recess 24 and which are spaced apart from each other in the radial direction. Each of the second electrodes 3 is oriented for being parallel to the first electrode 11.

In an embodiment shown in FIGS. 5 and 6, the second electrodes 3 are disposed on the upper end surface 27 with the lower communication port 253 located therebetween. Each of the second electrodes 3 may be, for example, an elongated thin copper plate which may be forced to extend through the outer peripheral surface 23 of the nozzle body 2 and the recess 24, and may abut on the upper end surface 27.

In an embodiment shown in FIGS. 5 and 6, the nozzle body 2 may further include two radial channels 28 which are opposite to each other in the radial direction. Each of the radial channels 28 is formed in the bottom surface 21 and extends to communicate the recess 24 and the outer peripheral surface 23.

In an embodiment shown in FIG. 5, the nozzle device 10 defines a port width (A) in the lower communication port 253 in the radial direction, a recess width (B) in the recess 24 between the lateral end surfaces 26, a recess depth (C) between each of the radial channels 28 and a respective one of the second electrodes 3, a channel depth (D) in each of the radial channels 28, a height (E) from an upper end of the lower tapered section 252 to a lower surface of each of the second electrodes 3, and a width (F) of the upper end of the lower tapered section 252 in the radial direction. A ratio of the port width (A) to the recess depth (C) may range from 1:1 to 1:5. In a non-limiting example, the port width (A) is 2 mm, the recess width (B) is 20 mm, the recess depth (C) is 10 mm, the channel depth (D) is 2 mm, the height (E) is 20 mm, and the width (F) is 24 mm. In other examples, the recess depth (C) may range from 2 mm to 10 mm. When implementing the electrochemical process, the bottom surface 21 of the nozzle body 2 may be abutted against the first electrode 11, and an electrolytic solution is forced into the longitudinal channel 25 from the top surface 22 and pressurized in the lower tapered section 252. The pressurized electrolytic solution flows into the recess 24 through the lower communication port 253, and is then discharged out of the nozzle device 10 through the radial channels 28.

Figure 8:
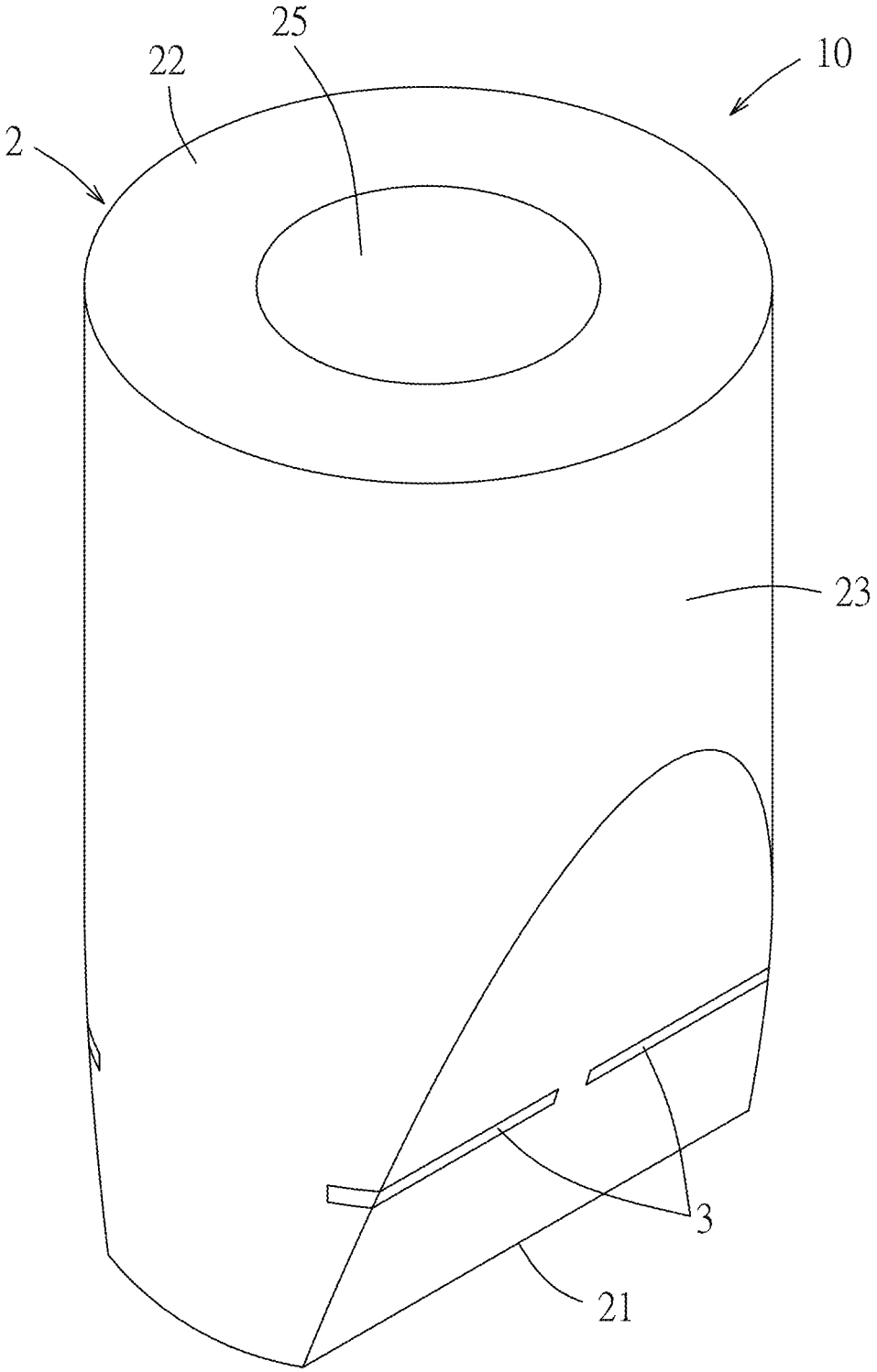
FIG. 8 is a schematic perspective view of a nozzle device according to a second embodiment of the disclosure.
Figure 9:
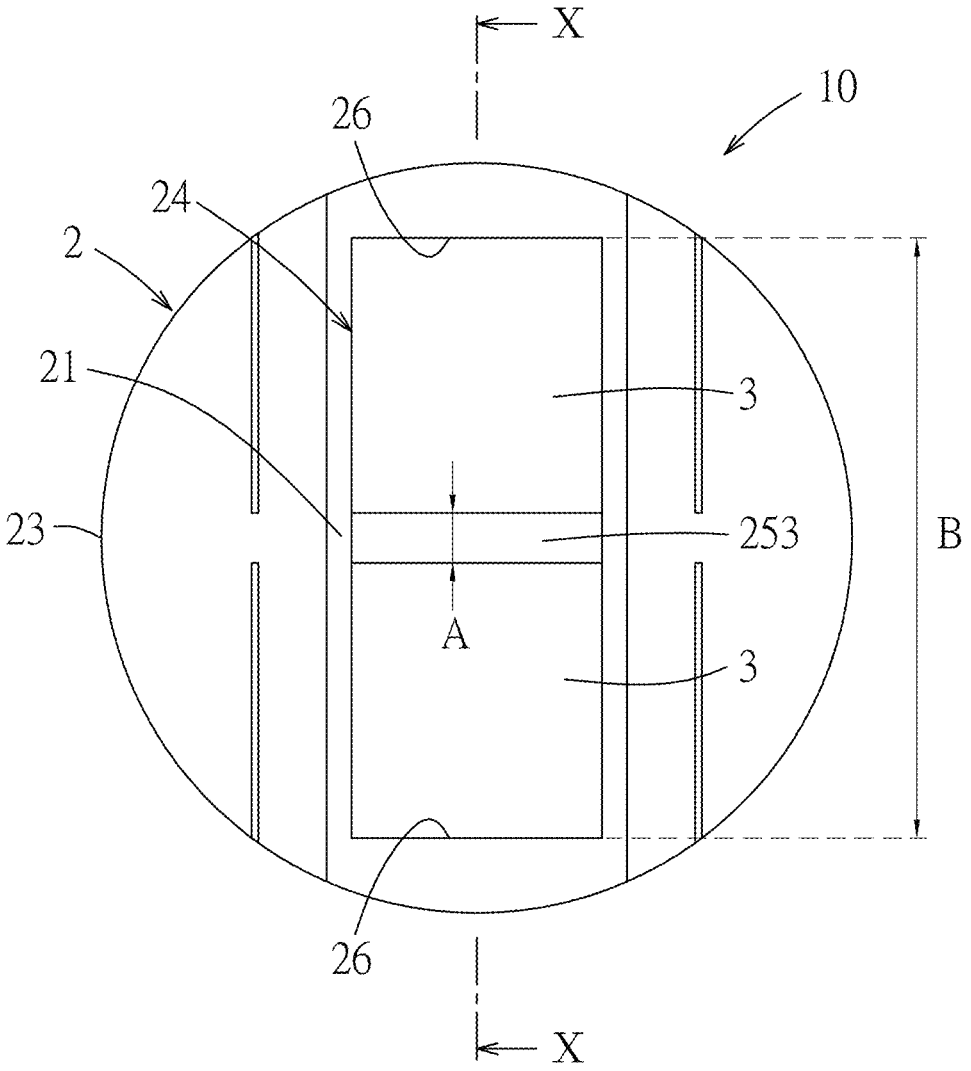
FIG. 9 is a bottom view of the second embodiment.
Figure 10:
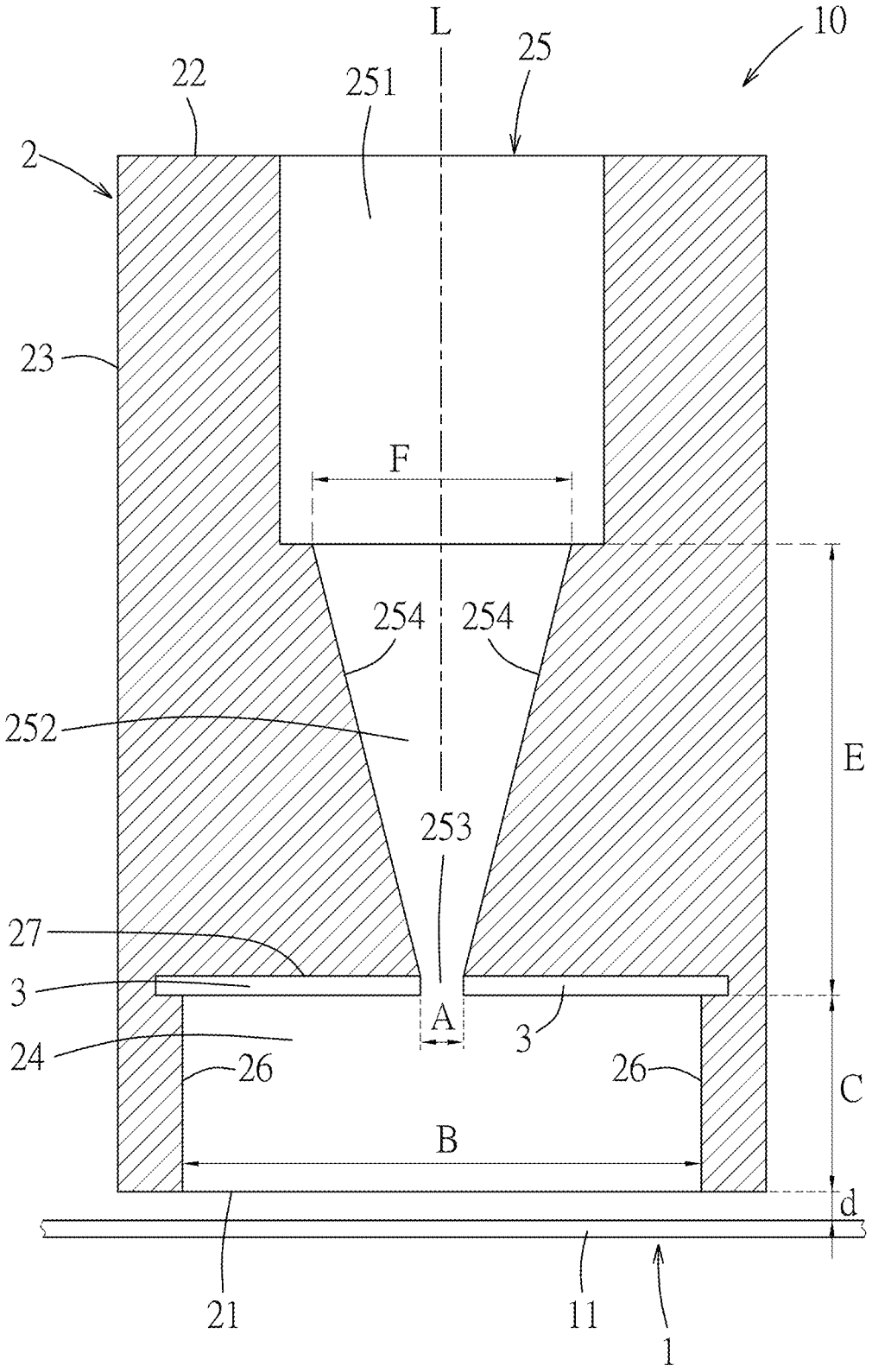
FIG. 10 is a cross-sectional view taken along line X-X of FIG. 9.

FIGS. 8 to 10 illustrate a nozzle device 10 according to a second embodiment of the disclosure. The second embodiment is similar to the first embodiment except that in the second embodiment, the radial channels 28 are not provided, and the outer peripheral surface 23 of the nozzle body 2 has two cutout portions. The recess width (B) of the recess 24 of the second embodiment may be larger than that of the first embodiment. In addition, as shown in FIG. 10, when implementing the electrochemical process, the bottom surface 21 of the nozzle body 2 may be spaced apart from the workpiece 1 by a distance (d) for discharging the electrolytic solution.

The embodiments of the disclosure will now be explained in more detail below by way of the following experiments. Those experiments are intended for purposes of illustration only and are not intended to limit the scope of the present disclosure.

Simulation Model

Figure 11:
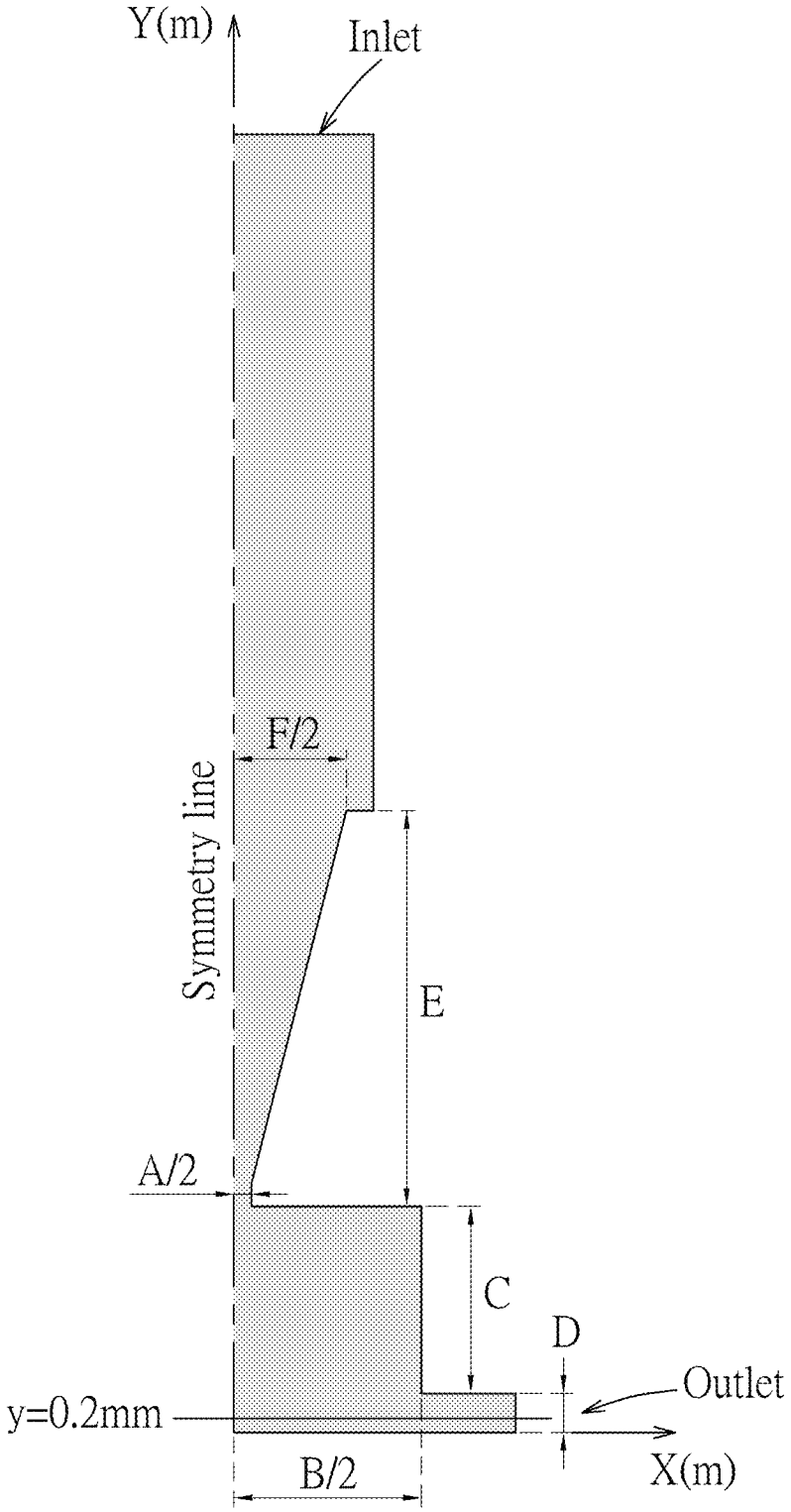
FIG. 11 is a geometry of a simulation model for the nozzle device of the disclosure.

FIG. 11 illustrates a two-dimensional simulation model for simulating a flow of the electrolytic solution in the nozzle device 10 shown in FIG. 5. The simulation model has an X axis in position on an upper surface of the first electrode 11, and a Y axis in position overlapping the longitudinal axis (L) which is a symmetry line of the nozzle device 10. An inlet of the flow, which corresponds to an inlet of the longitudinal channel 25, is at the top side of the simulation model, and an outlet of the flow, which may correspond to an outlet of one of the radial channels 28, is at the bottom side of the simulation model.

Flow Velocity Simulation

COMSOL Multiphysics software was used to simulate flows of the electrolytic solution in four simulation models (CE1, E1, E2, and E3). In each of the simulation models (CE1, E1, E2, and E3), a half of the port width (A/2) was set to be 1 mm, a half of the recess width (B/2) was set to be 10 mm, the channel depth (D) was set to be 2 mm, the height (E) was set to be 20 mm, the width (F/2) was set to be 12 mm, the temperature was set to be 298 k, and an inflow rate (flow rate at the inlet of the simulation model) was set to be 250 l/h. The recess depths (C) in the simulation models (CE1, E1, E2, and E3) were set to be 0 mm, 2 mm, 5 mm, and 10 mm, respectively. Horizontal flow rates of the electrolytic solution at the line (y=0.2 mm) for each of the simulation models (CE1, E1, E2, E3) were extracted from the simulation results and shown in FIG. 12. It is noted from FIG. 12 that the provision of the recess 24 shown in FIG. 5 or 10 may help to reduce the variation in the horizontal flow rate in an area in proximity to the first electrode 11.

Flow Pressure Simulation

The COMSOL Multiphysics software was used to simulate the flow pressures of the electrolytic solution in the four simulation models (CE1, E1, E2, and E3). The parameters for the four simulation models (CE1, E1, E2, and E3) were the same as those used in the flow velocity simulations. Flow pressures of the electrolytic solution at the line (y=0.2 mm) for each of the simulation models (CE1, E1, E2, E3) were extracted from the simulation results and shown in FIG. 13. It is noted from FIG. 13 that the provision of the recess 24 shown in FIG. 5 or 10 may help to reduce the variation in the flow pressure in the area in proximity to the first electrode 11.

Figure 12:
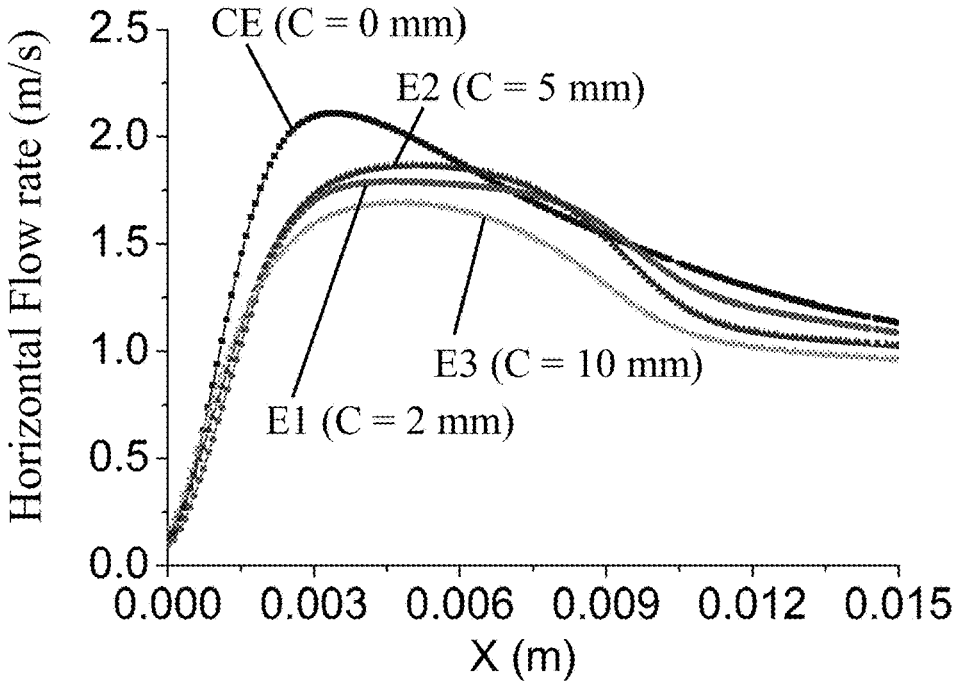
FIG. 12 is a graph illustrating, in four simulation models with different recess depths, the variation in a horizontal flow rate of an electrolytic solution on a first electrode to be plated.
Figure 13:
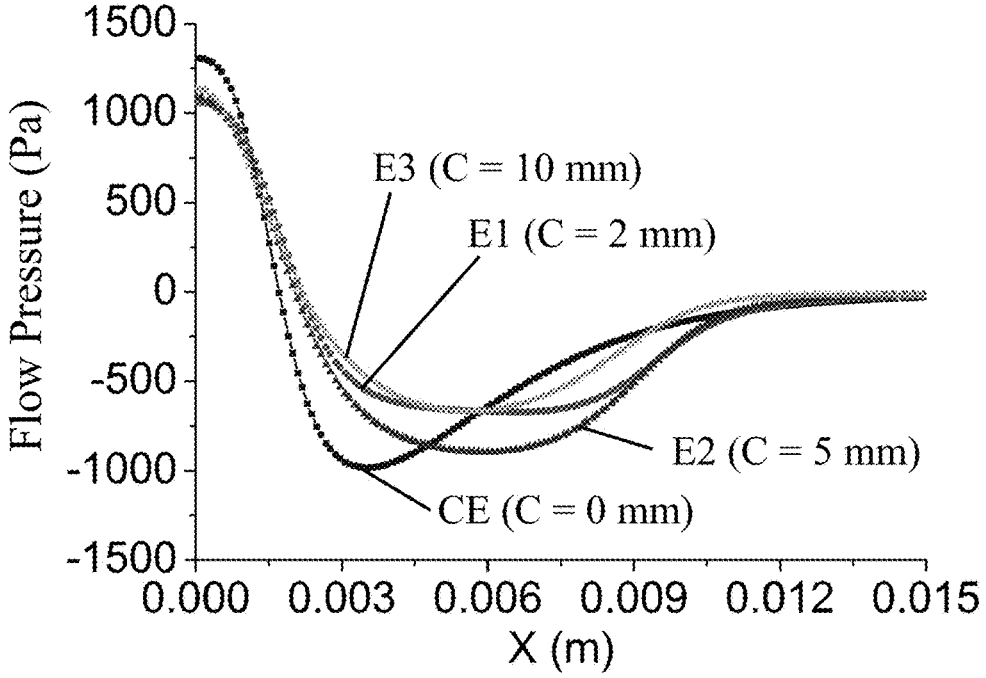
FIG. 13 is a graph illustrating, in the four simulation models, the variation in a flow pressure of the electrolytic solution on the first electrode.

From the results shown in FIGS. 12 and 13, because the variations in the horizontal flow rate and the flow pressure in the area in proximity to the first electrode 11 may be reduced in the nozzle device 10, the shear stress applied on the first electrode 11 during the electroplating process may be reduced, and a metal layer may be evenly formed on the first electrode 11 to have a dense structure.

First Plating Simulation

In the first plating simulation, the COMSOL Multiphysics software was used to simulate growth of metal layers on the first electrodes 11 in the four simulation models (CE1, E1, E2, and E3). In addition to the parameters used in the above simulations, a bulk concentration of Cu ions was set to be 0.5 mol/l and an anode voltage was set to be 0.135 V. In addition, in the simulation model (CE1), the second electrodes were set to be mounted on an inner peripheral surface of the upper section 251 shown in FIG. 5, while in the simulation models (E1 to E3), the second electrode 3 were set to be mounted on the upper end surface 27 of the recess 24.

Simulated plated thicknesses at different plating times (0 second, 1 second, 2 seconds, 3 seconds, 4 seconds, and 5 seconds) for the simulation models (CE1, E1, E2, and E3) were respectively shown in FIGS. 14A to 14D.

Figure 14A:
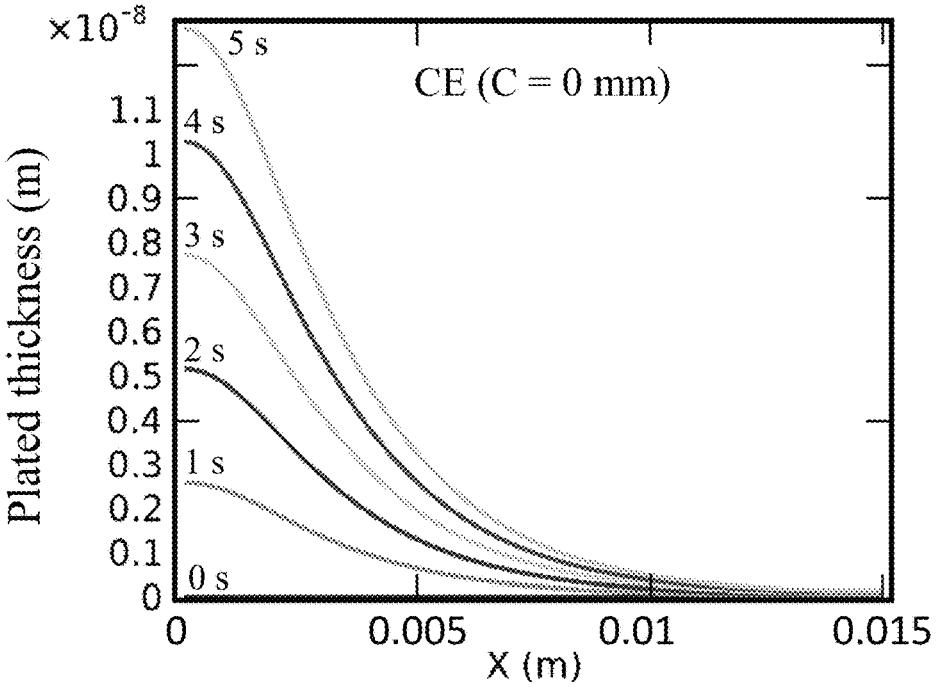
FIG. 14A to 14D are graphs respectively for the four simulation models, each graph illustrating the variation in a thickness of a metal layer plated on the first electrode at different plating times.

In the simulation model (CE1), as shown in FIG. 14A, when the recess 24 is not provided (i.e., the recess depth (C) is 0 mm), a thickness of a copper layer plated on the first electrode 11 is very uneven. This is because once the electrolytic solution is discharged from a smaller port (i.e., the lower communication port 253), the electrolytic solution is immediately brought into contact with the first electrode 11. Therefore, in the simulation model (CE1), the current density on the first electrode (cathode) is unevenly distributed.

Figure 14B:
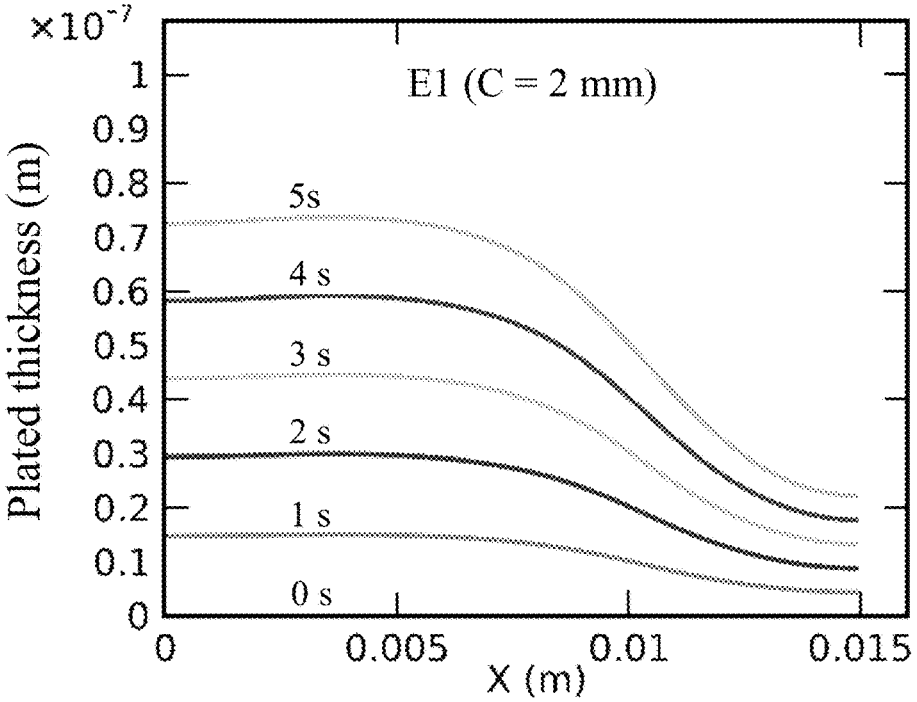
Figure 14C:
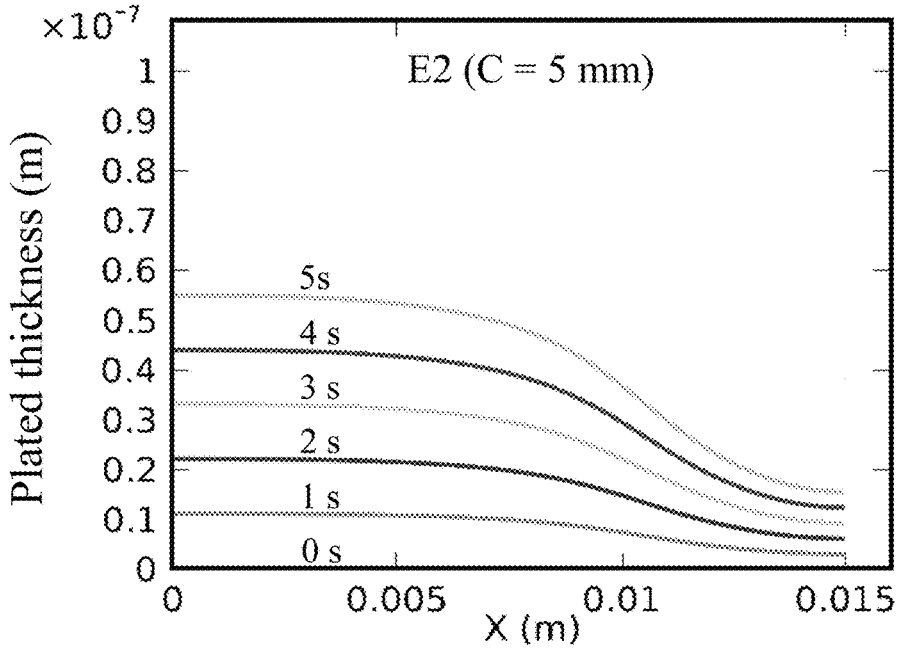
Figure 14D:
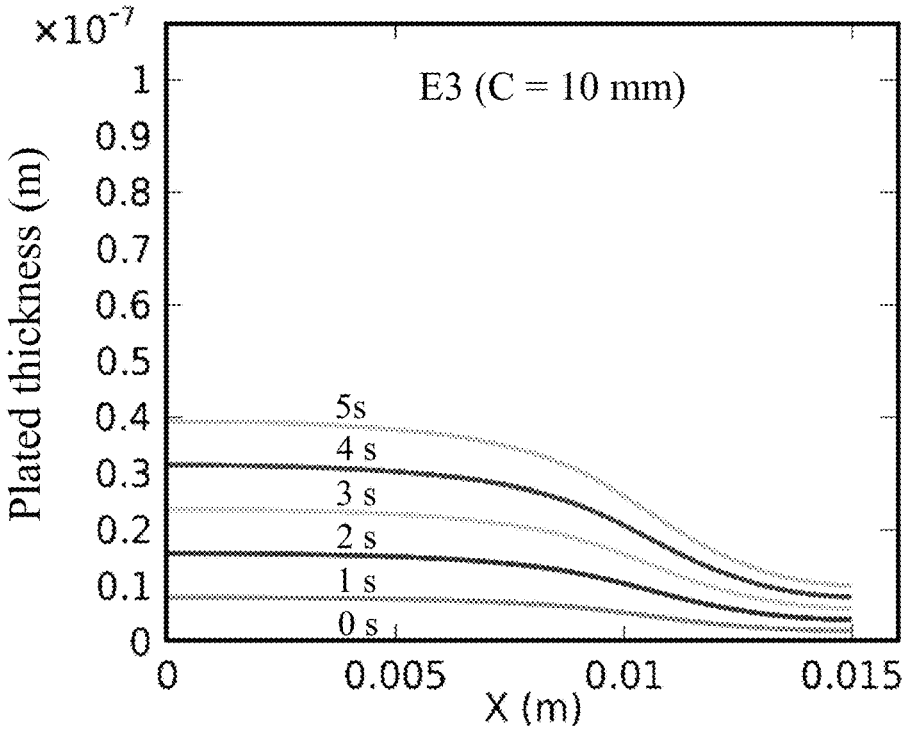

In the simulation models (E1 to E3), as shown in FIGS. 14B to 14D, with the increase of the recess depth (C), the metal plated on the first electrode 11 may have an increasingly even thickness distribution. In these cases, the recess 24 may serve as a buffer space for the electrolytic solution, and the electrolytic solution discharged from the lower communication port 253 will not be immediately brought into contact with the first electrode 11. Thus, in the simulation models (E1 to E3), the current density on the first electrode (cathode) is more evenly distributed.

Electroplating Experiment

Figure 15A:
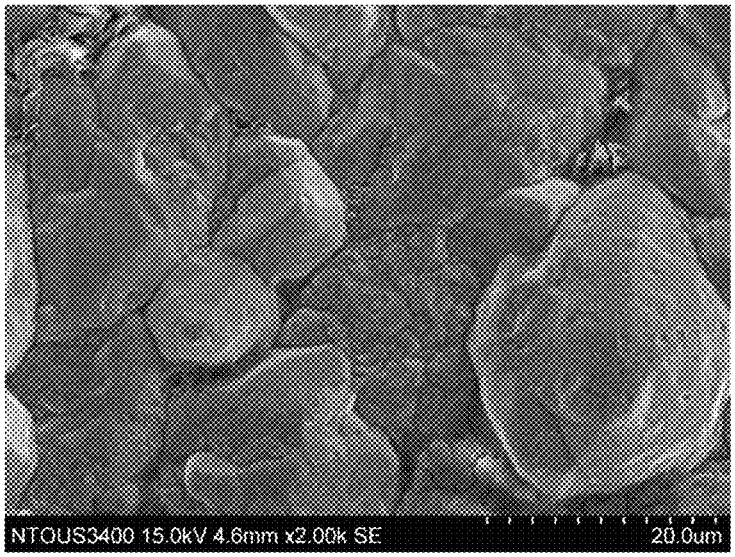
FIGS. 15A to 15C are scanning electron microscope images of plated metal layers formed using the nozzle devices with different recess depths.
Figure 15B:
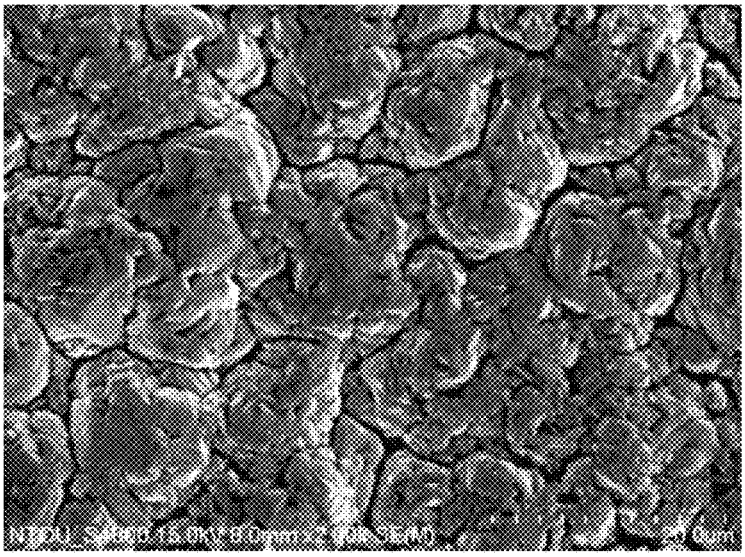
Figure 15C:
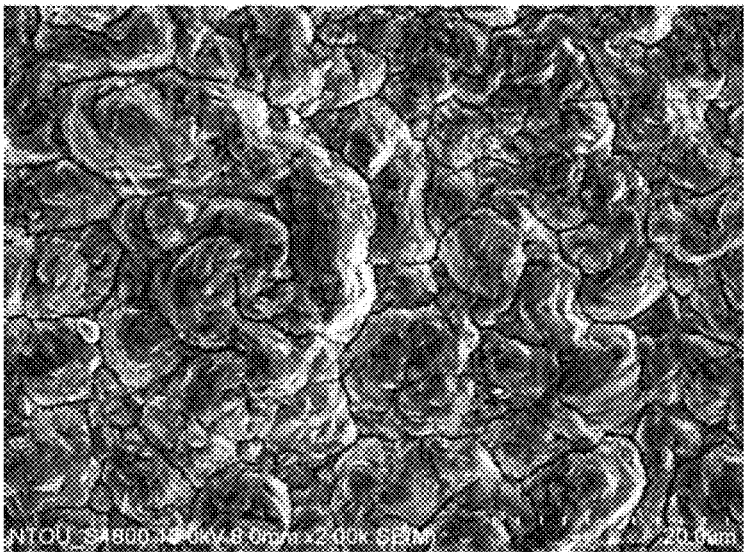

Three nozzle devices (CE 1, E2, and E3) were formed based on the three simulation models (CE1, E2, and E3), respectively. Three electroplating tests (CE 1, E2, and E3) were performed using the three nozzle devices (CE 1, E2, and E3), respectively. In each test, the temperature was set at 298 k, the electrolytic solution included an aqueous solution of copper(II) sulfate ($CuSO_4.5H_2O$, 250 g/l) and a sulfuric acid aqueous solution (0.5 M) in a volume ratio of 1:1 (a bulk concentration of Cu ions was 0.5 mol/l), an inflow rate of the electrolytic solution was set to be 250 l/h, and an average cathode current density was 5 $A/dm^2$. The SEM images of copper layers plated on the first electrodes in the three tests (CE1, E2, and E3) were shown in FIGS. 15A, 15B, and 15C, respectively. The copper layers (FIGS. 15B and 15C) formed using the nozzle devices (E1, E3) may have relatively dense structures in comparison with the copper layer (FIG. 15A) formed using the nozzle device (CE1).

Second Plating Simulation

Figure 16A:
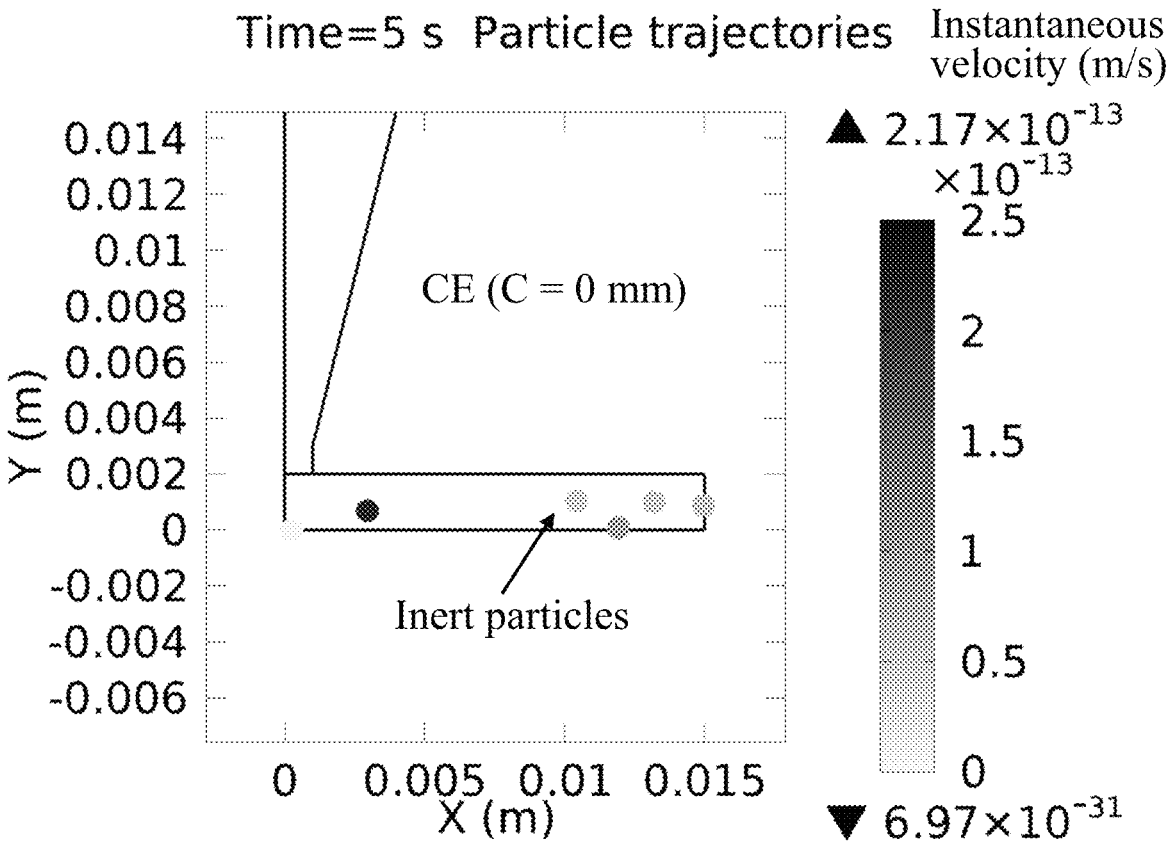
FIG. 16A to 16D are graphs respectively for the four simulation models, each graph illustrating inert particle distribution on a metal layer plated on the first electrode.
Figure 16B:
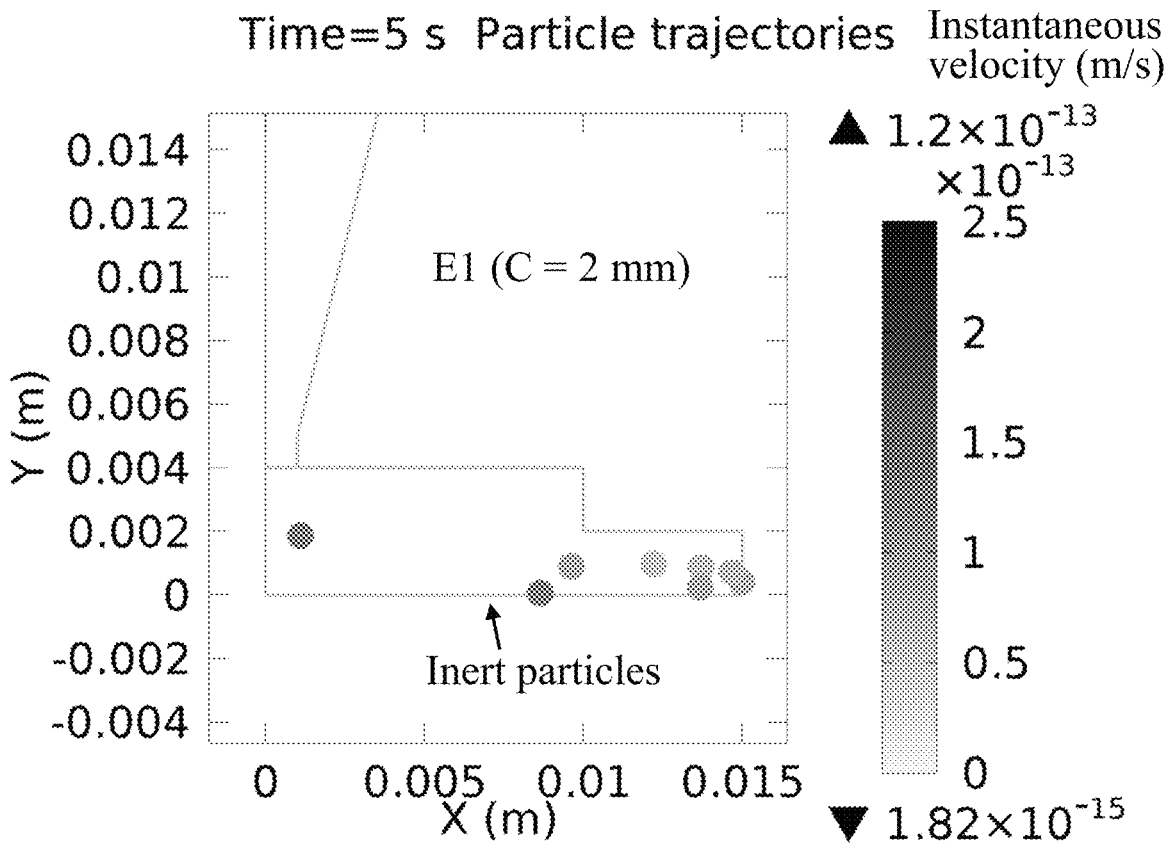
Figure 16C:
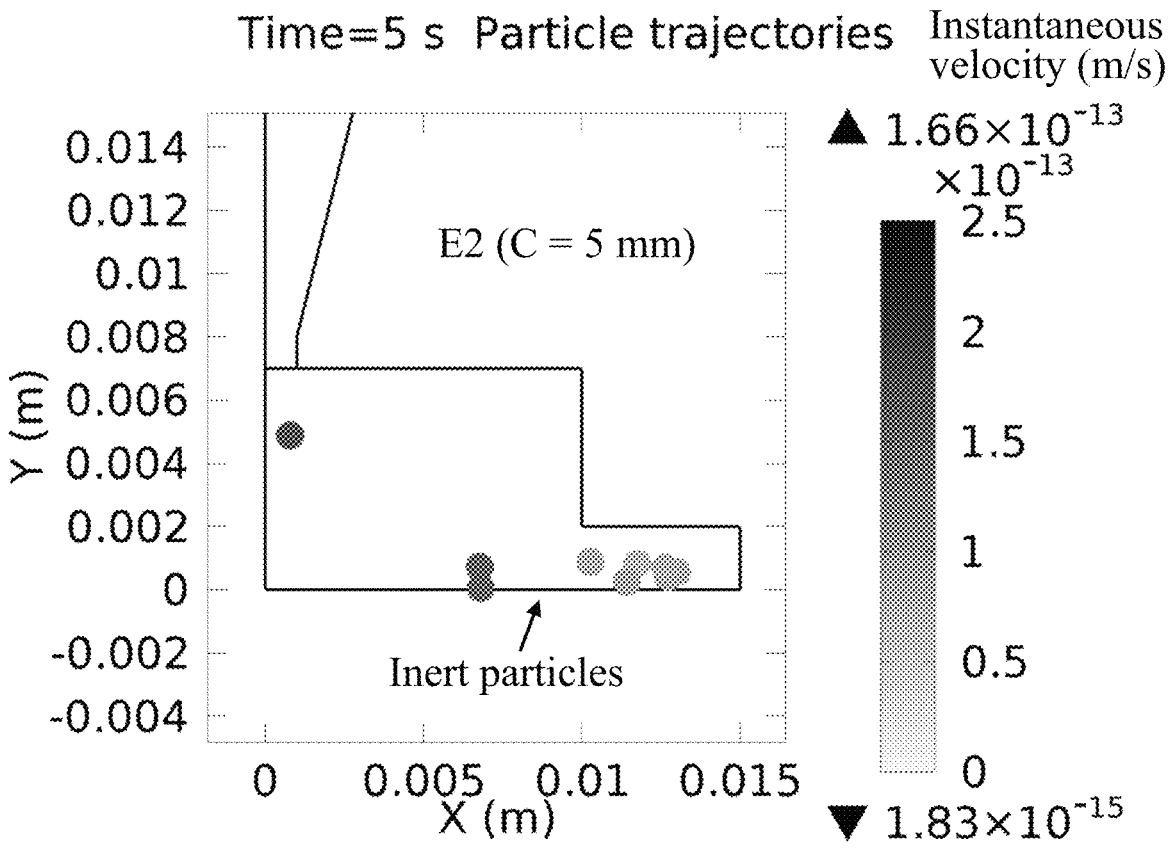
Figure 16D:
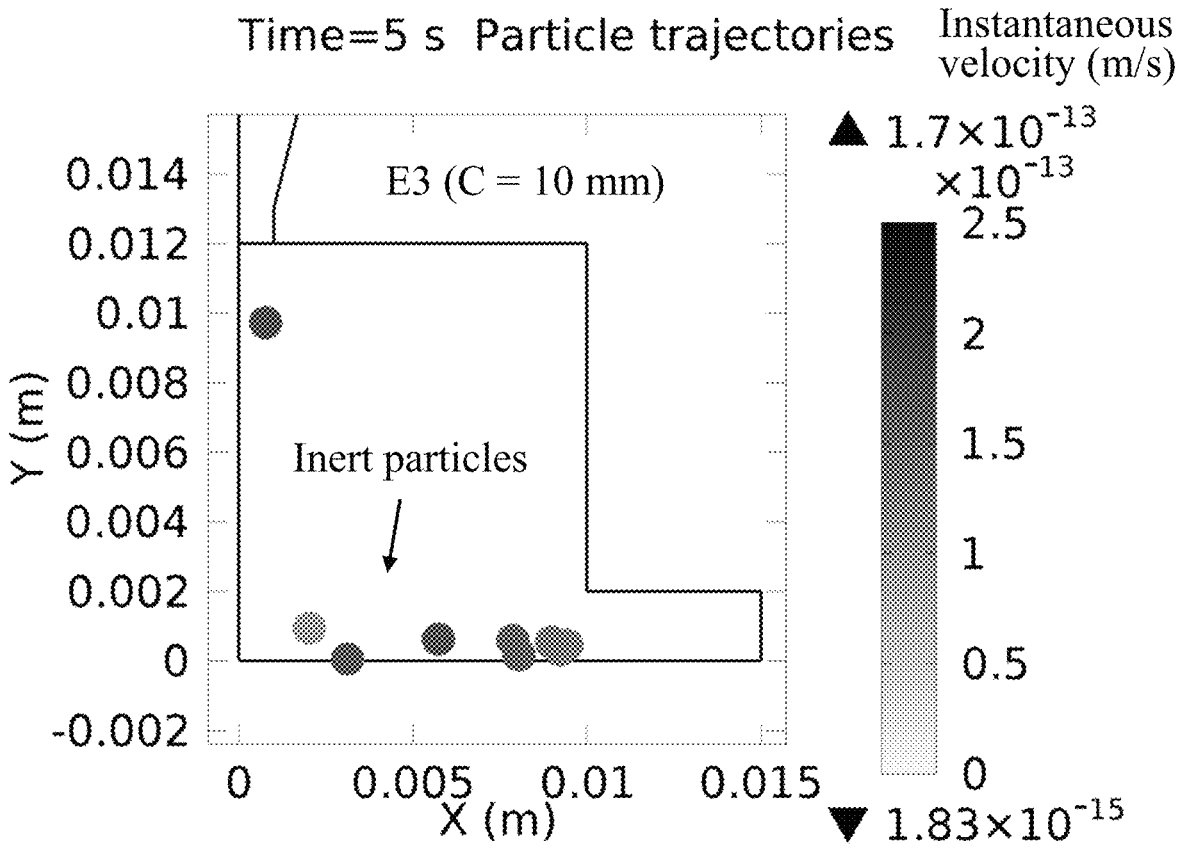

The second plating simulation was performed similarly to the first plating simulation except that inert particles (10 g/L) were added in the electrolytic solution. In this simulation, the inert particles were diamond particles having a particle density of 35 10 $kg/m^3$, particle diameter of $4\times10^{-6}$ m, and a charge number of 0. In addition, the plating time was set to be 5 seconds. Simulated results were shown in FIGS. 16A to 16D. It can be noted that a relatively higher proportion of the inert particles in each of the simulated copper layers (FIGS. 16B to 16D) of the simulation models (E1 to E3) may be in the range where X is between 0 m to 0.01 m in comparison with the copper layer (FIG. 16A) of the simulation model (CE1). This is because the recess 24 provides a buffer space for the electrolytic solution, which facilitates the co-deposition of the inert particles on the first electrode 11 in proximity to the lower communication port 253.

In sum, with the provision of the recess 24 in the nozzle device 10, and with the provision of the second electrode 3 in the recess 24, the variation in the horizontal flow rate and the flow pressure in proximity to the first electrode 11 may be reduced and the first electrode 11 to be plated or etched may be subjected to a reduced shear stress. Therefore, a metal plated layer may have a dense structure and more uniform thickness in comparison with the layer plated using a nozzle device without the recess 24. In addition, with the provision of the recess 24, a relatively large area on the first electrode 11 may be plated or etched using the nozzle device 10 of the disclosure.

Furthermore, the nozzle device 10 of the disclosure is also useful in increasing the proportion of inert particles in the metal layer. The inert particles may be provided for increasing the hardness, wear-resistance, and etch-resistance of the metal layer. Although the diamond particles were used in the above simulation, particles of $Al_2O_3$, SiC, and $CeO_2$ may also be used.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A nozzle device for subjecting a workpiece to an electrochemical process, the workpiece having a first electrode, said nozzle device comprising:

a nozzle body extending along a longitudinal axis to terminate at a top surface and a bottom surface for confronting the first electrode of the workpiece, said nozzle body having a recess provided in said bottom surface, and a longitudinal channel extending downwardly from said top surface along the longitudinal axis to be in fluid communication with said recess, said longitudinal channel having an upper section and a lower tapered section which is tapered downwardly to form a lower communication port; and at least one second electrode disposed in said recess for being spaced apart from the first electrode, wherein said at least one second electrode comprises two second electrodes disposed in said recess and spaced apart from each other in a radial direction relative to the longitudinal axis, each of said second electrodes being oriented for being parallel to the first electrode.

2. The nozzle device according to claim 1, wherein said lower tapered section has two inclined planar regions which are opposite to each other in the radial direction, and which are disposed at two opposite sides of said lower communication port.

3. The nozzle device according to claim 1, wherein said recess has an upper end surface in which said lower communication port is formed, and is elongated in the radial direction to terminate at two lateral end surfaces each extending in a direction of the longitudinal axis to be disposed between said upper end surface and said bottom surface, said second electrodes being disposed on said upper end surface with said lower communication port located therebetween.

4. The nozzle device according to claim 1, wherein said nozzle body further includes two radial channels which are opposite to each other in a radial direction relative to the longitudinal axis, each of said radial channels being formed in said bottom surface and extending to communicate said recess and an outer peripheral surface of said nozzle body.

* * * * *